US006386840B1

(12) United States Patent
Williams et al.

(10) Patent No.: US 6,386,840 B1
(45) Date of Patent: May 14, 2002

(54) OIL RETURN FOR REDUCED HEIGHT SCROLL COMPRESSOR

(75) Inventors: John R. Williams; Michael R. Young; Tracy Milliff; Darrell G. Murray, all of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/498,449

(22) Filed: Feb. 4, 2000

(51) Int. Cl.[7] ..... F04B 17/00; F01C 1/02

(52) U.S. Cl. ..... 417/371; 417/410.5; 418/55.6; 418/55.1

(58) Field of Search ..... 417/371, 410.5; 418/55.6, 55.1

(56) References Cited

U.S. PATENT DOCUMENTS 4,564,339 A * 1/1986 Nakamura et al. ..... 417/371
5,007,809 A * 4/1991 Kimura et al. ..... 417/371
5,447,418 A * 9/1995 Takeda et al. ..... 418/55.2
5,533,875 A * 7/1996 Crum et al. ..... 417/371
6,042,346 A * 3/2000 Doi ..... 417/371
6,106,254 A * 8/2000 Hirooka et al. ..... 418/55.6
6,247,907 B1 * 6/2001 Williams et al. ..... 417/410.5

FOREIGN PATENT DOCUMENTS

JP 4-76288 A * 3/1992 ..... 418/55.6

OTHER PUBLICATIONS

Avallone et al., ed.; Marks' Standard Handbook for Mechanical Engineers; Ninth Edition, 1987; pp. 8–45 to 8–46.*

* cited by examiner

*Primary Examiner*—Charles G. Freay
*Assistant Examiner*—Michael K. Gray
(74) *Attorney, Agent, or Firm*—Carlson, Gaskey & Olds

(57) ABSTRACT

A scroll compressor has a reduced height by having its suction tube aligned with its motor stator windings. The oil is returned from the scroll compressor to a compressor sump by confining the oil to flow through any of several structures such that it is isolated from refrigerant passing into a suction chamber through the suction tube. In this way, the oil which has been typically returned between the stator and the inner wall of the housing does not communicate with the refrigerant which is entering the housing. While the invention is shown in scroll compressor, it has benefits in other type compressors.

16 Claims, 3 Drawing Sheets

OIL RETURN FOR REDUCED HEIGHT SCROLL COMPRESSOR

BACKGROUND OF THE INVENTION

This application relates to a unique method and apparatus for returning the oil to a sump in a sealed compressor.

Sealed compressors are utilized in many refrigerant compression applications. In a typical sealed compressor, a pump unit is incorporated within a hermetically sealed housing. A refrigerant is introduced into the housing in a suction chamber through a suction tube. Typically, an electric motor drives a shaft which powers the pump unit. This refrigerant passes over the electric motor, cooling the motor. The refrigerant then passes into the pump unit, is compressed, and is passed to a discharge chamber. The suction and discharge chamber are separated by appropriate structure.

In one popular type of compressor pump unit, the compressor pump unit comprises a pair of scroll members. A scroll compressor includes two opposed scroll members each having a base and a generally spiral wrap extending from the base. One of the two scroll members is caused to be driven to orbit relative to the other. The wraps interfit, and as the wraps orbit, compression chambers defined between the wraps are reduced in volume.

Typically, sealed compressor housings have been a relatively long length. The suction tube has generally entered the chamber at a location aligned with the pump unit, or at least between the pump unit and the top end of the motor stator windings.

More recently, it has become desirable to reduce the height of sealed compressors, and in particular scroll compressors. However, certain problems become introduced with the reduced height sealed compressor. In one example, oil must be returned from the pump unit to a sump in the compressor. The oil will typically fall from the pump unit downwardly to the sump. However, it is also desirable to ensure that the oil is isolated from suction gas turbulence, as this could cause undesirable entrainment of the oil into the refrigerant entering the chamber.

This problem becomes particularly acute when the height is reduced, as it becomes more difficult to ensure that the returned oil does not pass in front of the suction tube.

SUMMARY OF THE INVENTION

In a disclosed embodiment of this invention, a sealed compressor incorporates a suction tube which is at least partially aligned with the windings on the motor stator for driving a compressor pump unit. An oil return tube returns oil from the compressor pump unit through a tube, and confines the oil return to a circumferential extent which does not include the suction tube. That is, the oil return tube ensures that the oil does not pass in front of the suction gas entering the compression chamber. Stated another way, the oil return structure prevents the returned oil from mixing with the suction gas.

In a preferred embodiment, the oil return tube is at a location generally opposed by 155° from the suction tube.

These and other features of the present invention can be best understood from the following specifications and drawings, the following of which is a brief description.

DETAILED DESCRIPTION OF A PREFERRED EMBODIMENT

Figure 1A:
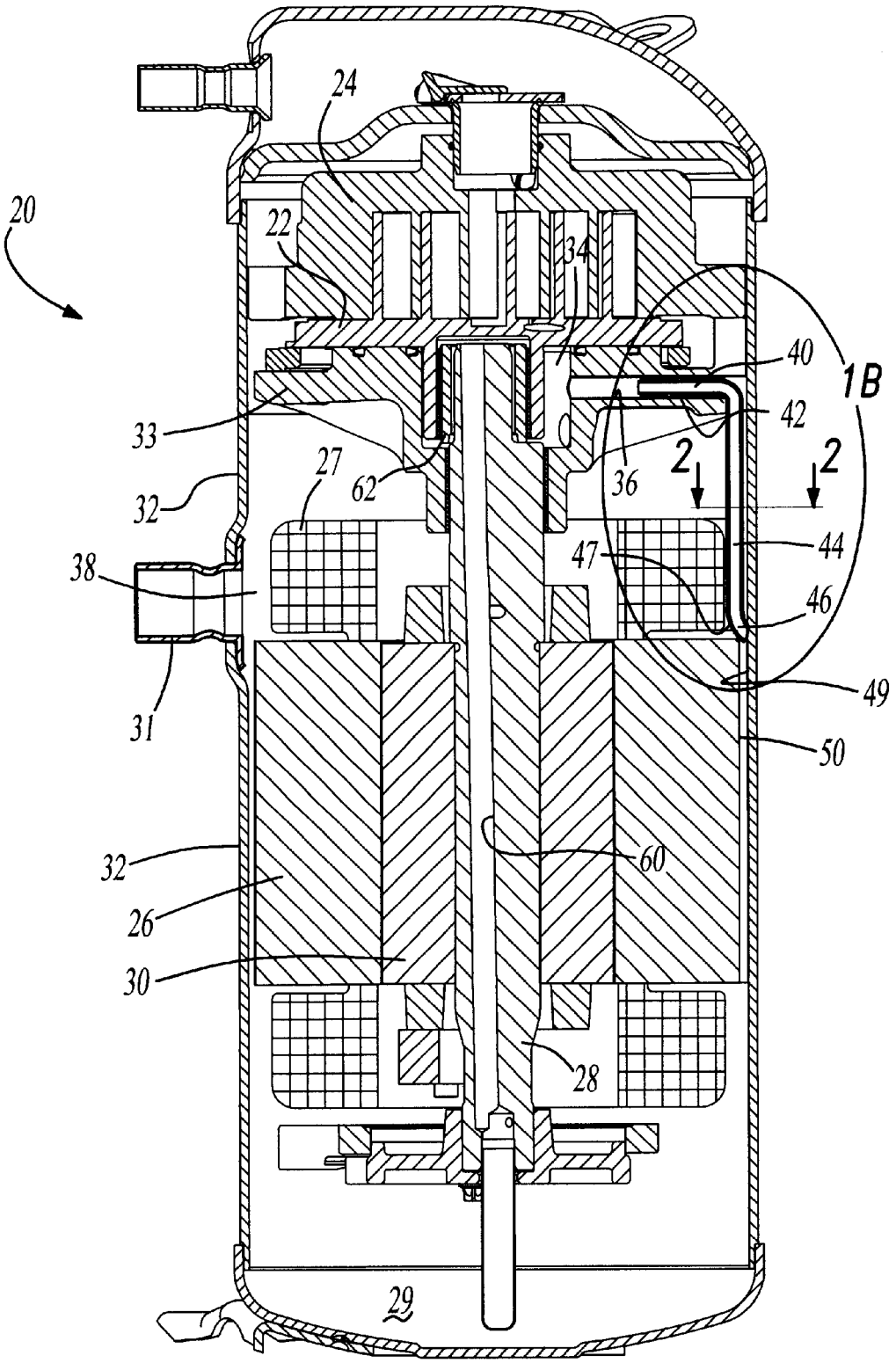
FIG. 1A is a cross-sectional view of a scroll compressor incorporating the present invention.
Figure 1B:
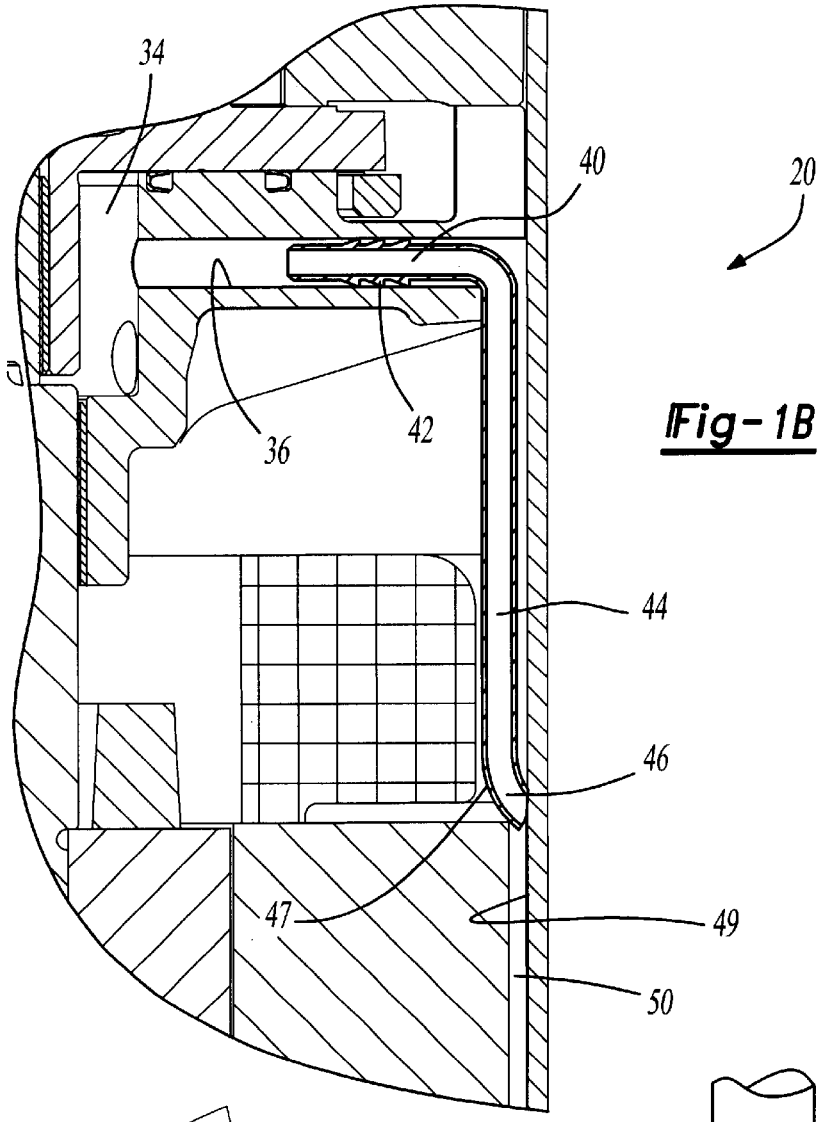
FIG. 1B is an enlarged view of one portion of FIG. 1A.

A scroll compressor 20 is illustrated in FIGS. 1A and 1B incorporating a orbiting scroll 22, and a non-orbiting or fixed scroll 24. A motor 26 has stator windings 27 driving a shaft 28 through a motor rotor 30. Shaft 28 and motor stator 26 are positioned above an oil sump 29. A suction tube 31 enters a compressor housing 32 within the axial extent of the windings 27. Tube 31 supplies refrigerant into a space 38 which communicates with the scroll compressor chambers. In the prior art, the suction tube typically was above the stator windings 27, and perhaps aligned with the pump unit components 22 and 24. As shown, a crankcase 33 supports the orbiting scroll 22.

An oil return chamber 34 is defined between the crankcase 33 and the orbiting scroll 22. An oil return passage 36 extends radially outwardly from the changer 34. A tube 40 is pressed into the passage 36, and has radially outer burrs 42 for being sealed within the passage 36. The tube 40 also has a downwardly extending portion 44 extending to a radially outwardly extending spout 46 which throws the oil outwardly against an inner wall 49 of the housing 32. The oil may then pass downwardly through a clearance 50 between the stator 26 and the inner wall 49 of the housing 32.

The present invention provides the benefit of returning oil from the chamber 34 downwardly to the sump 29 while isolated from suction gas turbulence. Stated another way, the present invention is directed to preventing return oil from being entrained in the refrigerant entering through the suction tube 31. The entrainment of oil into the suction tube introduced refrigerant becomes a particularly acute problem when the height of the compressor is reduced to move the suction tube to be aligned with the motor winding.

Figure 2:
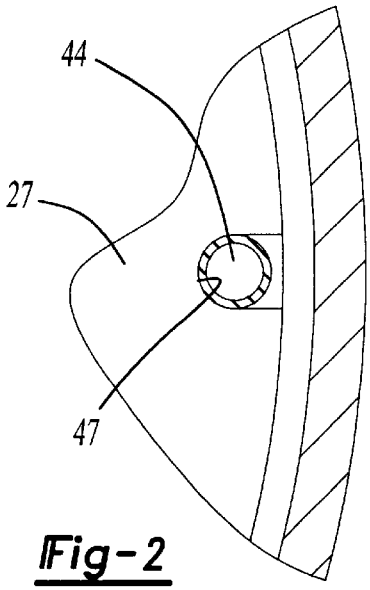
FIG. 2 is a cross-sectional view of the small portion of the motor of the present invention.

As can be appreciated from FIG. 2 and FIG. 1A, a recess 47 is formed in the outer periphery of the windings 27 to receive the tube 44. Recess 47 can be formed by blanking the windings, as known. This allows the tube to still be closely adjacent to an inner surface 49 of the housing 32 without requiring the motor windings to be spaced from the surface 49 by an undue amount. Further, this also provides better protection separating the returned oil from the refrigerant entering space 38.

Figure 3:
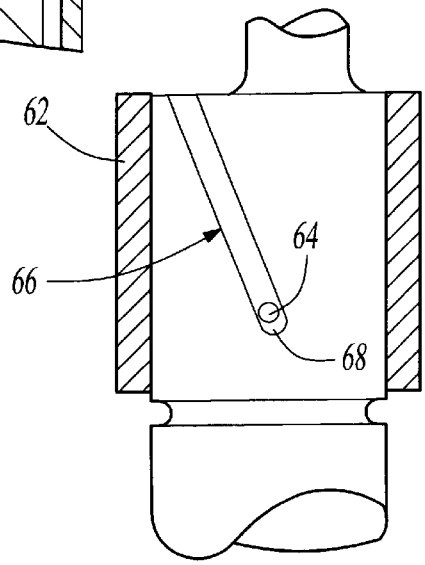
FIG. 3 shows oil supply structure.

As can be seen in FIG. 3 and FIG. 1A, an oil supply hole 60 extends through the shaft 28, and supplies lubricant to the location of the orbiting scroll 22. A bearing 62 supports an upper end shaft 28 within the orbiting scroll 22.

As can be best appreciated from FIG. 3, a passage 64 communicates radially outwardly through the shaft 28 at the location of the bearing 62. Passage 64 communicates with a passage 66 extending upwardly and having a blind end 68. The passage 66 does not extend to the bottom end of the bearing 62. Thus, the oil supply to the bearing will tend to flow upwardly, and then will fall into the chamber 34. Thus, a good deal of the oil supply to the bearing 62 will be returned to the chamber 34.

In this way, the inventive oil return structure will be likely to segregate a very large majority of the oil supplied to the compressor pump unit from the suction tube 31.

Figure 4:
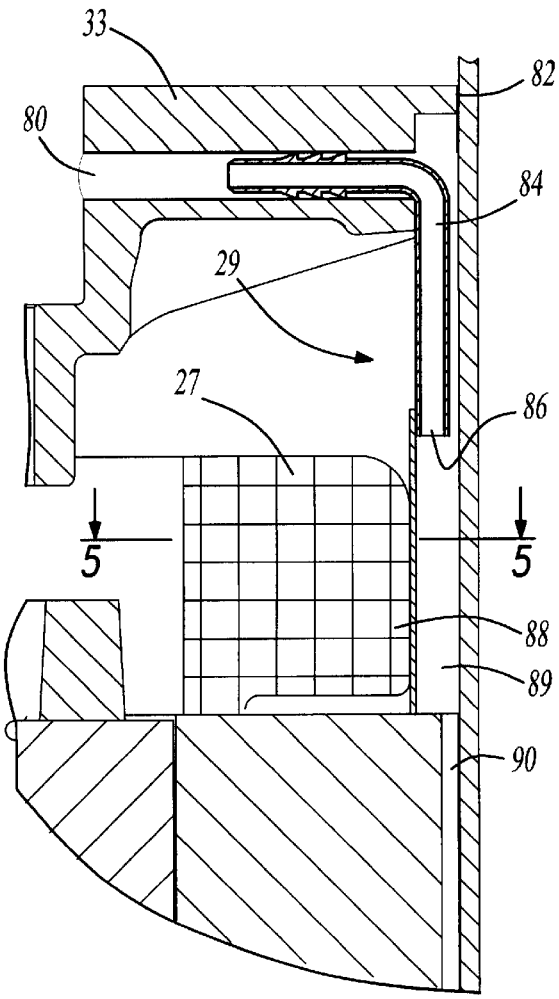
FIG. 4 shows another embodiment.

FIG. 4 shows another embodiment 79 wherein the passage 80 in the crankcase 33 extends outwardly toward the center shell 82. A partial tube 84 is again received in the passage 80, in a manner similar to the earlier embodiment. The tube 84 has a lower end 86 opening into a chamber 89. A shield 88 defines the chamber 89. It should be understood that the shield 88 need not provide a gas-tight seal on tube 84, as the purpose of the shield 88 is merely to prevent mixing between the returned oil and the suction gas.

In this embodiment, the winding 27 is not necessarily deformed, and the chamber 89 communicates with a clearance 90 between the stator and the shell housing 82.

Figure 5:
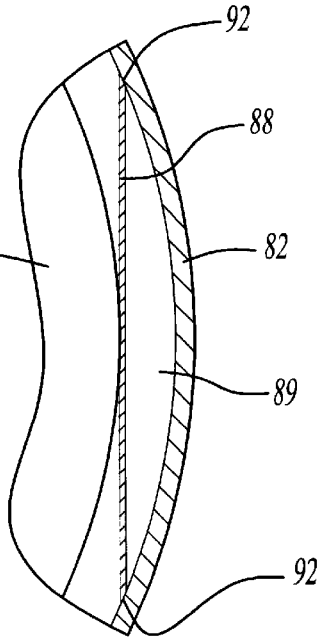
FIG. 5 shows an end view of the FIG. 4 embodiment.

As shown in FIG. 5, the shield is planar 88 extends between two ends 92 which contact the center shell 82. In this way, the chamber 89 is defined. That is, the shield generally extends along a line between the two ends 92 and contacts the cylindrical shell 82 at the two ends 92.

Figure 6:
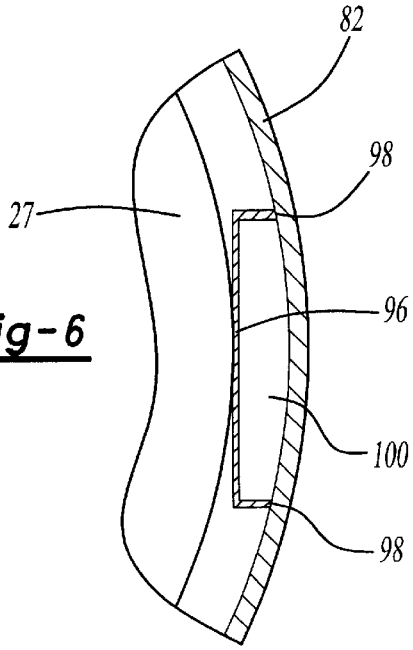
FIG. 6 shows an alternative embodiment.

FIG. 6 shows an alternative embodiment shield 96, wherein ends 98 extend from a central portion toward the shell 82. Here the chamber 100 is defined between the ends 98 and the shield 96. The shields 88 and 96 could be formed of sheet metal, plastic, or any suitable material.

Figure 7:
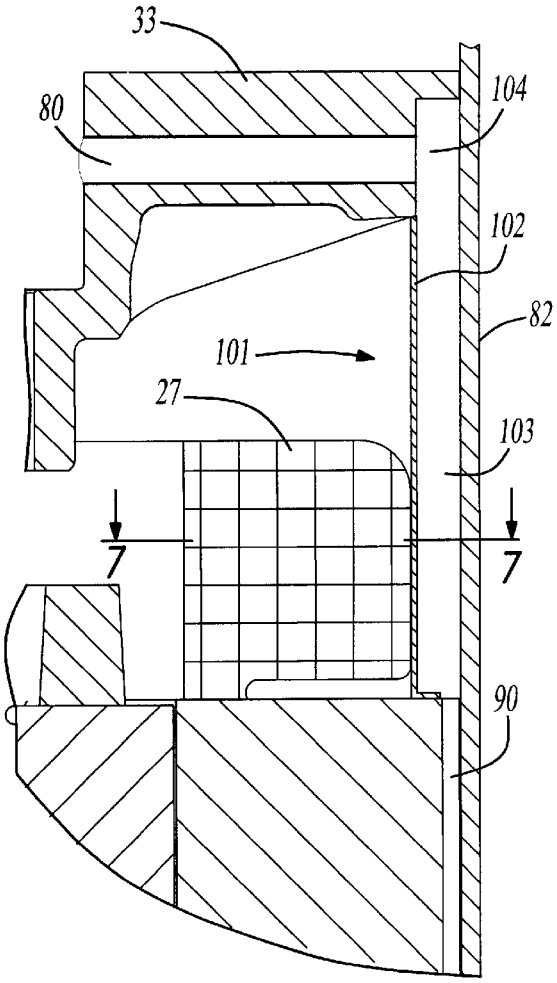
FIG. 7 shows yet another alternative.

FIG. 7 shows yet another embodiment 101, wherein the shield 102 extends from the crankcase 33 downwardly to move beyond the motor windings 27. Essentially, this embodiment eliminates the tube 84 from the FIG. 4 embodiment. This embodiment communicates the chamber 104 at the end of the passage 80 directly into a chamber 103 defined by the shield 102. The shield could have the configuration shown in FIG. 5 or FIG. 6.

It should be understood that while the majority of oil being returned to the sump should pass through the oil shields, etc. of this invention, some oil may still pass through other structures back downwardly to the sump. The main purpose of this invention is to isolate a substantial quantity of the oil.

Although the invention has been disclosed with reference to a scroll compressor, it should be understood that other sealed compressors would benefit from this invention.

Although a preferred embodiment has been disclosed, a worker of ordinary skill in this art would recognize that modifications would come within the scope of this invention. For that reason, the following claims should be studied to determine the true scope and content of this invention.

What is claimed is:

1. A compressor unit comprising:

a sealed housing enclosing a compressor pump unit;

a motor for driving a shaft about an axis to drive said compressor pump unit, said motor having a rotor and a stator, said stator being provided with stator windings defining a first end and a second end;

a suction tube inlet for introducing a refrigerant into said sealed housing, said suction tube inlet being axially aligned with at least a portion of said stator windings, such that a clearance is provided between a radially outer portion of said stator windings at said first end, and a radially inner end of said suction tube; and structure for supplying oil to said compressor pump unit, and an oil return chamber, said oil return chamber communicating with oil return structure, said oil return structure returning oil from said chamber to a sump adjacent a second end of said sealed chamber, said oil return structure preventing oil being returned from said chamber to said sump from communicating with refrigerant in said clearance between said suction tube and said motor stator, said oil return structure including a tube located circumferentially spaced from said suction tube, said first end being defined adjacent said compressor pump unit, and at least a portion of said stator windings at said first end of said motor being aligned with said suction tube inlet.

2. A compressor as recited in claim 1, wherein said oil return tube includes a first portion force fit into a passage in a housing associated with said compressor pump unit, and a second portion extending from said first portion.

3. A compressor as recited in claim 1, wherein said oil return structure incorporates structure to separate said returned oil from said clearance.

4. A compressor as recited in claim 1, wherein said compressor pump unit is a scroll compressor pump unit.

5. A compressor as recited in claim 4, wherein a crankcase supports a orbiting scroll in said scroll compressor unit, said crankcase and said orbiting scroll defining said return chamber, and said oil return structure extending radially outwardly from said oil return chamber.

6. A compressor unit comprising:

a sealed housing enclosing a compressor pump unit;

a motor for driving a shaft about an axis to drive said compressor pump unit, said motor having a rotor and a stator, said stator being provided with stator windings defining a first end and a second end;

a suction tube inlet for introducing a refrigerant into said sealed housing, said suction tube inlet being axially aligned with at least a portion of said stator windings, such that a clearance is provided between a radially outer portion of said stator windings at said first end, and a radially inner end of said suction tube;

structure for supplying oil to said compressor pump unit, and an oil return chamber, said oil return chamber communicating with oil return structure, said oil return structure returning oil from said chamber to a sump adjacent a second end of said sealed chamber, said oil return structure preventing oil being returned from said chamber to said sump from communicating with refrigerant in said clearance between said suction tube and said motor stator;

said oil return structure includes a tube located circumferentially spaced from said suction tube, said oil return tube includes a first portion force fit into a passage in a housing associated with said compressor pump unit, and a second portion extending from said first portion; and said second portion extends to a spout extending radially outwardly from said second portion to direct returned oil against an inner wall of said housing.

7. A compressor as recited in claim 6, wherein said motor windings have a recess which receives said oil return tube.

8. A compressor unit comprising:

a sealed housing enclosing a compressor pump unit;

a motor for driving a shaft about an axis to drive said compressor pump unit, said motor having a rotor and a stator, said stator being provided with stator windings defining a first end and a second end;

a suction tube inlet for introducing a refrigerant into said sealed housing, said suction tube inlet being axially aligned with at least a portion of said stator windings, such that a clearance is provided between a radially outer portion of said stator windings at said first end, and a radially inner end of said suction tube;

structure for supplying oil to said compressor pump unit, and an oil return chamber, said oil return chamber communicating with oil return structure, said oil return structure returning oil from said chamber to a sump adjacent a second end of said sealed chamber, said oil return structure preventing oil being returned from said chamber to said sump from communicating with refrigerant in said clearance between said suction tube and said motor stator;

said oil return structure includes a shield isolating a portion of said clearance from said suction tube; and an oil return tube communicates a passage in an housing member downwardly into a chamber, said chamber being defined in part by said shield.

9. A compressor as recited in claim 8, wherein said shield includes ends which extend generally radially outwardly to contact an inner periphery of said sealed housing, along with a planar portion extending between said ends.

10. A scroll compressor comprising:

a first scroll member including a first base and a generally spiral wrap extending from said first base;

a second scroll member including a second base and a generally spiral wrap extending from said second base, said generally spiral wraps of said first and second scroll members interfitting to define compression chambers;

a shaft for driving said second scroll member to orbit relative to said first scroll member;

an electric motor having a rotor for driving said shaft and a stator for powering said rotor;

a housing providing a sealed chamber, said motor being received within a suction chamber in said sealed housing, a suction tube extending through said housing to communicate a refrigerant into said suction chamber, said motor stator incorporating windings at a first end adjacent said scroll members relative to said motor stator, said suction tube being at least partially axially aligned with a portion of said winding, an axial dimension being defined along a rotational axis of said shaft; and oil return structure for returning oil to a sump defined at a second end of said stator opposed from said first end, said oil return structure ensuring that oil being returned from an oil return chamber would not communicate with refrigerant passing between said suction tube and said winding, said oil return structure including a tube located circumferentially spaced from said suction tube, said first end being defined adjacent said compressor pump unit, and stator windings at said first end of said motor being at least partially axially aligned with said suction tube inlet.

11. A scroll compressor comprising:

a first scroll member including a first base and a generally spiral wrap extending from said first base;

a second scroll member including a second base and a generally spiral wrap extending from said second base, said generally spiral wraps of said first and second scroll members intermitting to define compression chambers;

a shaft for driving said second scroll member to orbit relative to said first scroll member;

an electric motor having a rotor for driving said shaft and a stator for powering said rotor;

a housing providing a sealed chamber, said motor being received within a suction chamber in said sealed housing, a suction tube extending through said housing to communicate a refrigerant into said suction chamber, said motor stator incorporating windings at a first end adjacent said scroll members relative to said motor stator, said suction tube being at least partially axially aligned with a portion of said winding, an axial dimension being defined along a rotational axis of said shaft;

oil return structure for returning oil to a sump defined at a second end of said stator opposed from said first end, said oil return structure ensuring that oil being returned from an oil return chamber would not communicate with refrigerant passing between said suction tube and said winding;

said oil return structure includes a tube located at a location circumferentially spaced from said suction tube; and said motor windings have a recess which receives said tube.

12. A scroll compressor comprising:

a first scroll member including a first base and a generally spiral wrap extending from said first base;

a second scroll member including a second base and a generally spiral wrap extending from said second base, said generally spiral wraps of said first and second scroll members interfitting to define compression chambers;

a shaft for driving said second scroll member to orbit relative to said first scroll member;

an electric motor having a rotor for driving said shaft and a stator for powering said rotor;

a housing providing a sealed chamber, said motor being received within a suction chamber in said sealed housing, a suction tube extending through said housing to communicate a refrigerant into said suction chamber, said motor stator incorporating windings at a first end adjacent said scroll members relative to said motor stator, said suction tube being at least partially axially aligned with a portion of said windings, an axial dimension being defined along a rotational axis of said shaft;

oil return structure for returning oil to a sump defined at a second end of said stator opposed from said first end, said oil return structure ensuring that oil being returned from an oil return chamber would not communicate with refrigerant passing between said suction tube and said winding;

said oil return structure includes a tube located at a location circumferentially spaced from said suction tube;

said oil return structure includes a shield isolating a portion of said clearance from said suction tube; and an oil return tube communicates a passage in a housing member downwardly into a chamber, said chamber being defined in part by said shield.

13. A scroll compressor comprising:

a first scroll member including a first base and a generally spiral wrap extending from said first base;

a second scroll member including a second base and a generally spiral wrap extending from said second base, said generally spiral wraps of said first and second scroll members interfitting to define compression chambers;

a shaft for driving said second scroll member to orbit relative to said first scroll member;

an electric motor having a rotor for driving said shaft and a stator for powering said rotor;

a cylindrical housing providing a sealed chamber, said motor being received within a suction chamber in said sealed housing, a suction tube extending through said housing to communicate a refrigerant into said suction chamber, said motor stator incorporating windings at a first end adjacent said scroll members relative to said motor stator, said suction tube being at least partially axially aligned with a portion of said winding, an axial dimension being defined along a rotational axis of said shaft;

oil return structure for returning oil to a sump defined at a second end of said stator opposed from said first end, said oil return structure ensuring that oil being returned from an oil return chamber would not communicate with refrigerant passing between said suction tube and said winding;

said oil return structure includes a tube located at a location circumferentially spaced from said suction tube;

said oil return structure includes a shield isolating a portion of said clearance from said suction tube; and said shield extending generally in a plane and defining a chamber within an inner periphery of said sealed housing, said shield extending generally along a line to define said plane, said line being defined to intersect two circumferentially spaced points on said housing, such that said shield is generally planar and extending between two spaced ends each contacting an inner periphery of said cylindrical housing.

14. A compressor as recited in claim 13, wherein said shield includes ends which extend generally radially outwardly to contact an inner periphery of said sealed housing, along with a planar portion extending between said ends.

15. A compressor unit comprising:

a sealed housing enclosing a compressor pump unit;

a motor for driving a shaft about an axis to drive said compressor pump unit, said motor having a rotor and a stator, said stator being provided with stator windings defining a first end and a second end;

a suction tube inlet for introducing a refrigerant into said sealed housing, said suction tube inlet being axially aligned with at least a portion of said stator windings, such that a clearance is provided between a radially outer portion of said stator windings at said first end, and a radially inner end of said suction tube; and structure for supplying oil to said compressor pump unit, and an oil return chamber, said oil return chamber communicating with oil return structure, said oil return structure returning oil from said chamber to a sump adjacent a second end of said sealed chamber, said oil return structure preventing oil being returned from said chamber to said sump from communicating with refrigerant in said clearance between said suction tube and said motor stator, said oil return structure including a tube located circumferentially spaced from said suction tube, said motor windings having a recess to receive said tube.

16. A compressor as recited in claim 15, wherein said compressor pump unit is a scroll compressor.

* * * * *

UNITED STATES PATENT AND TRADEMARK OFFICE

CERTIFICATE OF CORRECTION

PATENT NO. : 6,386,840 B1
DATED : May 14, 2002
INVENTOR(S) : Williams et al.

It is certified that error appears in the above-identified patent and that said Letters Patent is hereby corrected as shown below:

Title page,
Inventors, should read as follows:
-- [75] Inventors: John R. Williams, Bristol, VA (US); Michael R. Young, Bristol, TN (US); Tracy Milliff, Bristol, VA (US); Darrell G. Murray, Bristol, VA (US) --

Signed and Sealed this

Fifth Day of November, 2002

*Attest:*

*Attesting Officer*

JAMES E. ROGAN
*Director of the United States Patent and Trademark Office*